United States Patent [19]

Mizumura

[11] 4,332,195

[45] Jun. 1, 1982

[54] VARIABLE-AMPLITUDE VIBRATOR FOR INKING ROLLERS IN PRINTING PRESSES

[75] Inventor: Shizuo Mizumura, Fussa, Japan

[73] Assignee: Kabushiki Kaisha Tokyo Kikai Seisakusho, Tokyo, Japan

[21] Appl. No.: 207,200

[22] Filed: Nov. 14, 1980

[30] Foreign Application Priority Data

Nov. 19, 1979 [JP] Japan ..... 54/148807

[51] Int. Cl.[3] ..... B41F 31/14; B41L 27/16

[52] U.S. Cl. ..... 101/349; 101/DIG. 14

[58] Field of Search ..... 101/348, 349, 350, 148, 101/351, 352, DIG. 14, 205, 206, 207, 208, 209, 353–358, 359–362; 74/25, 53, 54, 55, 835, 836

[56] References Cited

U.S. PATENT DOCUMENTS 1,563,014 11/1925 Carroll ..... 101/DIG. 14

2,138,779 11/1938 Avery ..... 101/348

FOREIGN PATENT DOCUMENTS 693114 11/1930 France ..... 101/DIG. 14

*Primary Examiner*—J. Reed Fisher

*Attorney, Agent, or Firm*—Armstrong, Nikaido, Marmelstein & Kubovcik

[57] ABSTRACT

For imparting end-to-end vibration to an inking roller in a printing press, a worm is fixedly mounted on one of the opposite trunnions of the inking roller. A worm wheel in mesh with the worm is rotatably carried by a reciprocator which is mounted on the trunnion for vibratory motion therewith but which permits its rotation. An eccentric shaft extends eccentrically through the worm wheel for simultaneous rotation therewith about the axis of the latter. A pair of offset extensions projecting eccentrically from the opposite ends of the eccentric shaft are engaged in stationary guideways and thereby constrained to rectilinear reciprocation in a direction normal to the trunnion axis, for transforming the rotation of the worm wheel into the endwise vibration of the inking roller via the reciprocator. The amplitude of the vibration can be varied stepwise by causing angular displacement of the eccentric shaft about its own axis with respect to the worm wheel and by locking the eccentric shaft to the worm wheel in a desired angular position.

7 Claims, 7 Drawing Figures

VARIABLE-AMPLITUDE VIBRATOR FOR INKING ROLLERS IN PRINTING PRESSES

BACKGROUND OF THE INVENTION

This invention relates to printing presses, and more specifically to those of the rotary type including one or more inking rollers. Still more specifically, the invention pertains to a variable-amplitude vibrator for imparting end-to-end vibratory motion to an inking roller, or to each inking roller, in a printing press with a view to the creation of an ink film of constant thickness on the plate cylinder or cylinders.

Printing presses having inking rollers capable of endwise or axial vibration have been known and used extensively in the printing industry. In some such printing presses it is frequently practiced to deliver two or more inks of different colors to the separate, longitudinally divided sections of the plate cylinder from the inking rollers. This multiple-color printing method necessitates the employment of some measure to prevent the intermingling of the adjacent inks due to the endwise vibration of the inking rollers.

One of the known measures adopted for the above purpose, in cases where the images to be printed to different colors will always be in the same locations in the axial direction of the plate cylinder, is the formation of annular grooves between the adjacent roller and cylinder sections. If the image locations are subject to change from run to run, the use of ink scrapers has been common for scraping the inks off the safe surface regions between the different image areas. The widths of these surface regions, and the amplitude of vibration of the inking rollers, must of course be varied depending upon how close the image areas lie to each other.

Generally speaking, inking rollers should spread ink as far as possible to give beautiful prints. If circumstances permit, therefore, their vibratory motions should be of the maximum practical amplitude.

The foregoing considerations lead one to the conclusion that the amplitude of vibration of inking rollers must be adjustably variable in as many, and as fine, steps as possible. Most of conventional variable-amplitude vibrators used for the purpose in question, however, offer an inconveniently small number of steps of amplitude change.

Another problem with the prior art arises from the fact that a single variable-amplitude vibrator has been used for driving all the inking rollers in a printing press. Since the inking rollers vibrate in phase according to this conventional arrangement, excessive vibrations develop and travel to the other undesired parts of the press, thereby impairing its durability and actually lessening its useful life.

SUMMARY OF THE INVENTION

The present invention aims at the provision of an improved variable-amplitude vibrator, for use with an inking roller in a printing press, permitting a multiple-step change in the amplitude of vibration developed thereby. The invention also seeks to avoid the phasing of the vibratory motions of two or more inking rollers incorporated in a single press.

Stated in brief, the improved vibrator according to the invention includes a worm to be fixedly mounted on one of the opposite trunnions of an inking roller supported for both rotary motion and endwise vibratory motion. In mesh with the worm is a worm wheel which is rotatably supported by a reciprocator which is mounted on the trunnion for vibratory motion therewith but which permits rotation of the trunnion. An eccentric shaft is supported eccentrically by the worm wheel for simultaneous rotation therewith about the axis of the latter and for angular displacement about its own axis relative to the worm wheel. Projecting eccentrically from one, preferably each, of the opposite ends of the eccentric shaft, an offset extension of this shaft is engaged in a guideway which is defined by stationary guide means and which extends perpendicular to the axis of the trunnion. The vibrator further includes an amplitude adjustment mechanism for adjustably varying the distance between the axis of the worm wheel and the axis of the offset extension of the eccentric shaft. For thus varying the distance between the two axes the eccentric shaft is to be angularly displaced about its own axis relative to the worm wheel and secured thereto in a selected angular position.

Thus, upon rotation of the inking roller with its trunnions, the offset extension of the eccentric shaft reciprocates linearly along the stationary guideway, thereby acting to transform the rotation of the worm wheel into the endwise vibratory motion of the inking roller via the reciprocator. The amplitude adjustment makes it possible to vary the amplitude of the vibratory motion, simply by revolving the eccentric shaft from one predetermined angular position to another with respect to the worm wheel. An increase in the number of such predetermined angular positions of the eccentric shaft leads to a multiple-step change in vibration amplitude.

According to a further feature of the invention, in a printing press having two or more inking rollers, the vibrator of the above outlined construction is to be independently provided for each inking roller. The several vibrators can determine the relative phases of the vibratory motions developed thereby, in such a way that the vibrations of the individual rollers will counteract and cancel each other. A more detailed discussion of this feature will appear in the following disclosure.

The above and other features and advantages of this invention and the manner of attaining them will become more apparent, and the invention itself will best be understood, from a study of a preferable embodiment given hereinbelow, with reference had to the attached drawings.

DESCRIPTION OF THE PREFERRED EMBODIMENT

Figure 1:
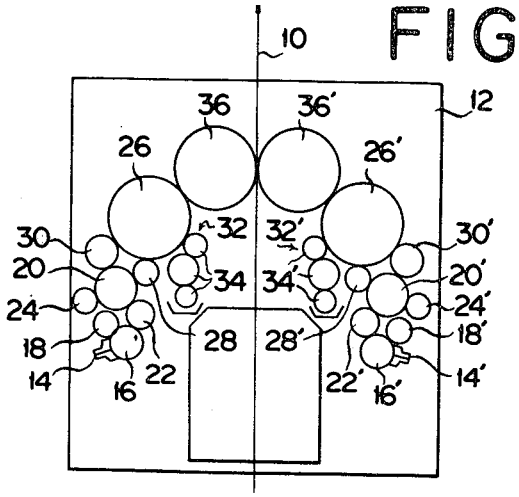
FIG. 1 is a schematic diagram of an offset perfecting press having four inking rollers each vibrated end to end in accordance with this invention.

The present invention will now be described more specifically as adapted for a web-fed offset perfecting press shown diagrammatically in FIG. 1. As is well known, the offset perfecting press prints both sides of a web 10 of paper or other material at one time, using a blanket-to-blanket method of transferring the printed impression to the web. This method eliminates the usual impression cylinder and uses the blanket of the opposite side as the impression cylinder to transfer the image to the web. Since the pair of printing mechanisms of the offset perfecting press, lying on the opposite sides of the web 10, are of identical make, only one of them will be described in detail. The various parts of the other printing mechanism will be identified in the drawing merely by priming the reference numerals used to denote the corresponding parts of the representative mechanism.

The illustrated offset perfecting press includes a pair of opposed walls 12, one seen, between which extend the various working parts of the press hereinafter set forth. Disposed on the left hand side of the web 10, the representative printing mechanism comprises an ink-distributing rail assembly 14 in relative sliding contact with a first inking roller 16. The ink on this first inking roller is spread by a spreading roller 18 and transferred on to a second inking roller 20 via a transfer roller 22. Again spread as the second inking roller 20 revolves in contact with another spreading roller 24, the ink is then applied to a plate cylinder 26 via two applying rollers 28 and 30.

Shown at 32 is a water mechanism comprising dampening rollers 34 for moistening the nonprinting areas of the printing plate, not shown, clamped around the plate cylinder 26. Only the printing areas of the plate accept the ink from the applying rollers 28 and 30. The plate prints the inked image on the surface of the blanket, not shown, fastened to a blanket cylinder 36. The printed image is then offset or transferred to the web 10, as it passes between the blanket cylinder 36 and the blanket cylinder 36′ of the other printing mechanism, by pressure exerted therebetween.

The construction of the offset perfecting press as so far described is conventional, and therein lies no feature of the present invention. The invention specifically concerns a variable-amplitude vibrator for application of controlled end-to-end vibration to each of the inking rollers 16, 16′, 20 and 20′, with a view to the formation of ink films of constant thickness on the printing plates enwrapping the plate cylinders 26 and 26′.

Figure 3:
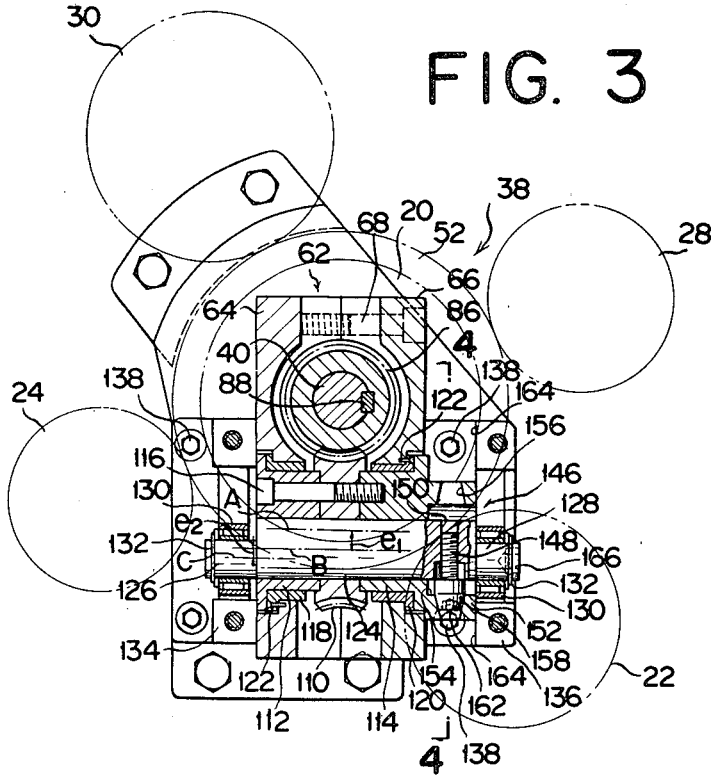
FIG. 3 is a sectional view, taken along the line 3—3 of FIG. 2, of the variable-amplitude vibrator.
Figure 2:
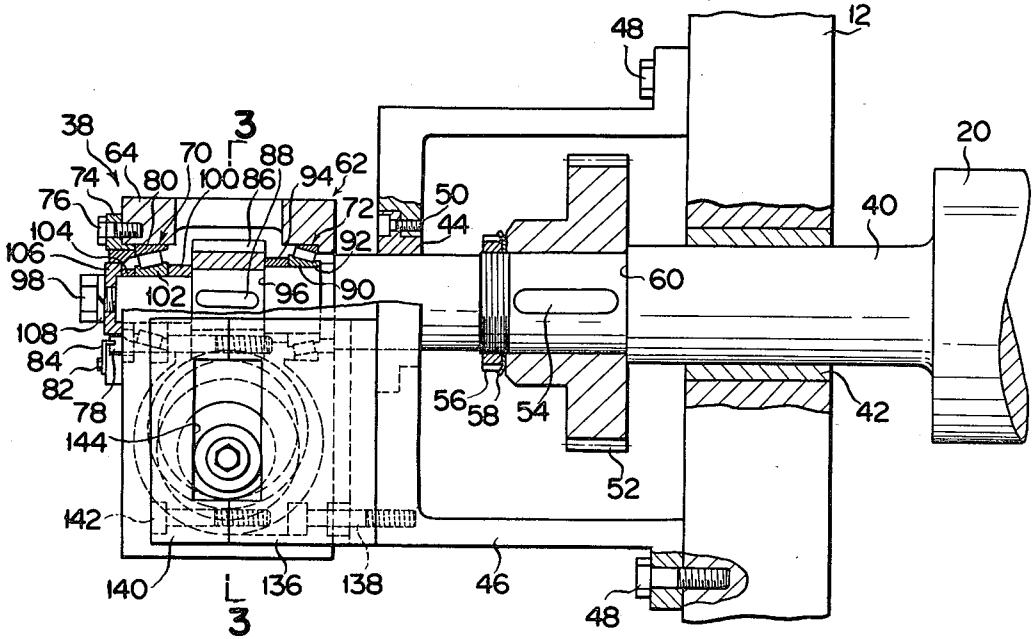
FIG. 2 is an enlarged, fragmentary side elevational view, partly broken away and sectioned, of one of the inking rollers and of the variable-amplitude vibrator associated therewith.

FIGS. 2 and 3 show one such variable-amplitude vibrator, generally labeled 38, as mounted in place on the printing press for imparting endwise vibration to a representative one, 20, of the inking rollers. With reference first to FIG. 2 the representative inking roller 20 has a pair of trunnions 40, one shown, extending coaxially away from its opposite ends. Of stepped configuration the illustrated trunnion 40 extends through a sleeve bearing 42 in the press wall 12 and another sleeve bearing 44 in a mount 46. This mount is fastened to the press wall 12 as by capscrews 48. The press wall 12 with its sleeve bearing 42 and the mount 46 with its sleeve bearing 44 support the trunnion 40 so as to permit both rotary motion and axial reciprocation, within limits, of the inking roller 20. The sleeve bearing 44 is screwed at 50 to the mount 46.

A spur gear is mounted at 52 on the trunnion 40 and locked against relative rotary motion by a key 54. Further, for restraining the gear 52 from axial displacement, a locknut 56 coacts with a washer 58 to hold the gear against a step 60 of the trunnion 40. The gear 52 meshes with a drive gear, not shown, for revolving the inking roller 20 in a predetermined direction.

Reference is now directed to both FIGS. 2 and 3 in order to describe the construction of the variable-amplitude vibrator 38. It includes a reciprocator or carrier 62 of generally boxlike shape. The reciprocator 62 consists of two halves 64 and 66 which are joined as by capscrews, one shown at 68 in FIG. 3. FIG. 2 shows that the reciprocator 62 is rotatably mounted on the end of the trunnion 40 via two taper-rolling bearings 70 and 72, in order to permit rotation of the trunnion. The reciprocator itself is prevented from rotation with respect to, for example, the press wall 12 by means hereinafter referred to.

A flanged, internally threaded, short tubular member 74 is screwed at 76 to one end of the reciprocator 62. An externally threaded, short tubular member 78 is screwed into the internally threaded member 74, to abut against the outer race 80 of the bearing 70 under pressure. Screwed at 82 to the flange of the internally threaded member 74, a locking pawl 84 locks the externally threaded member 78 against rotation.

Within the reciprocator 62 a worm 86 is keyed at 88 to the trunnion 40. The worm 86 holds the inner race 90 of the bearing 72 against a step 92 of the trunnion 40 via a collar 94. The worm itself is held against another trunnion step 96 by a screw 98, driven axially into the extreme end of the trunnion 40, via a collar 100, the inner race 102 of the bearing 70, another collar 104, a rimmed retainer disc 106, and a spring washer 108.

It is thus seen that the reciprocator 62 is locked against axial displacement relative to the trunnion 40. The inking roller 20 is to vibrate end to end as the reciprocator 62 reciprocates with the trunnion 40, as will become better understood as the description progresses.

Mounted on the trunnion 40 for both rotary and vibratory motions therewith as above, the worm 86 meshes with a worm wheel 110 disposed within the reciprocator 62. A pair of flanged, hollow shafts 112 and 114 lies on the opposite sides of the worm wheel 110 and are coaxially fastened thereto and to each other as by capscrews 116. These hollow shafts are rotatably mounted to the reciprocator halves 64 and 66 via flanged sleeve bearings 118 and 120, respectively. Countersunk flat-head capscrews 122 secure the sleeve bearings 118 and 120 to the reciprocator halves 64 and 66. Thus the worm wheel 110 and the hollow shafts 112 and 114 are jointly rotatable about a common axis A relative to the reciprocator 62. The flanges on the hollow shafts 112 and 114 and on the sleeve bearings 118 and 120 prevent the worm wheel and hollow shafts from axial displacement relative to the reciprocator. Although the worm wheel and the hollow shafts are shown as individual members, they might be considered an integral unit for the purposes of this invention.

An eccentric shaft 124 extends eccentrically through the worm wheel 110 and hollow shafts 112 and 114 for rotation therewith about the axis A. Further the eccentric shaft 124 is rotatable about its own axis B relative to the worm wheel and the hollow shafts. Projecting from the opposite ends of the eccentric shaft 124 are a pair of offset extensions or journals 126 and 128 or reduced diameter. Each offset extension of the eccentric shaft 124 is fitted in a needle bearing 130, which is locked in place by a retainer ring 132.

The pair of offset extensions 126 and 128 have a common axis C, displaced from the axis A of the worm wheel 110 and the hollow shafts 112 and 114 and from the axis B of the eccentric shaft 124. The distance e1 between the axes A and B is made greater than the distance e2 between the axes B and C.

As will be seen from both FIGS. 2 and 3, a pair of guides 134 and 136 lie on the opposite sides of the reciprocator 62 and are rigidly anchored to the mount 46 as by capscrews 138. Another pair of guides 140, one seen in FIG. 2, are fastened to the respective guides 134 and 136, also as by capscrews 142. Each of the guides 134 and 136 define in combination with the corresponding one of the guides 140 a guideway 144 oriented vertically or perpendicular to the axis of the trunnion 40. The pair of offset extensions 126 and 128 of the eccentric shaft 124 are engaged one in each guideway 144 thereby to be constrained to rectilinear reciprocation in a vertical direction. Thus, upon rotation of the worm wheel 110 and hollow shafts 112 and 114 along the axis A, the pair of offset extensions of the eccentric shaft 124 reciprocate up and down along the guideways 144 to cause reciprocatory or vibratory motion of the reciprocator 62, and hence of the trunnion 40, in its axial direction.

The vibrator 38 further comprises an amplitude adjustment 146, FIG. 3, for adjustably varying the amplitude of vibration of the inking roller 20 in several steps. Included in this amplitude adjustment is a lockpin 148 in the form of a taper-headed, threaded pin which is threadedly engaged in a diametral bore 150 formed in the eccentric shaft 124 in the vicinity of its offset extension 128. The right hand hollow shaft 114 has an offset extension 152 centered about the axis B. This offset extension has an annular internal recess 154 and so encircles part of the eccentric shaft 124 with clearance.

Figure 4A:
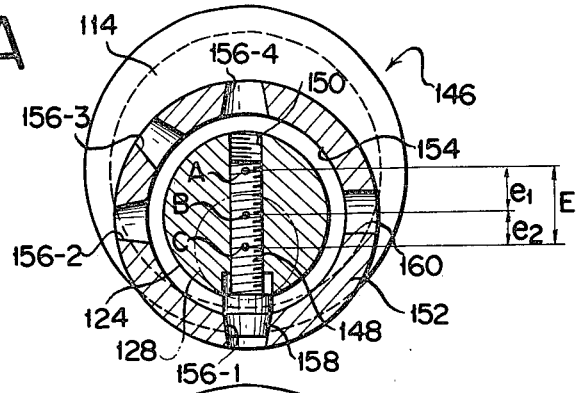
FIG. 4A is an enlarged sectional view, taken along the line 4—4 of FIG. 3, of the amplitude adjustment in the vibrator.
Figure 4B:
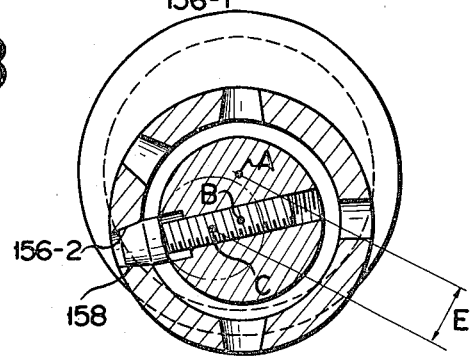
FIGS. 4B, 4C and 4D are all views similar to FIG. 4A and explanatory of the way in which the amplitude of vibration of the inking roller is varied by the amplitude adjustment.

As better shown in FIGS. 4A through 4B, the offset extension 152 of the hollow shaft 114 has a plurality of, four in the illustrated embodiment, radial taper bores 156 formed therethrough at desired angular spacings. Projecting from the diametral bore 150 in the eccentric shaft 124, the taper head 158 of the lockpin 148 is to be snugly engaged in any selected one of the radial taper bores 156 in the hollow shaft extension 152. Normally, therefore, the eccentric shaft 124 is locked to the hollow shaft 114 for rotation therewith about the axis A. A cylindrical bore 160 also formed radially through the hollow shaft extension 152 is intended for the insertion of a tool in turning the eccentric shaft 124 about its own axis B relative to the hollow shaft 114, as will be later explained in more detail.

In operation, upon rotation of the inking roller trunnion 40 by the gear drive, the worm 86 thereon causes rotation of the worm wheel 110, together with the pair of hollow shafts 112 and 114, about the axis A. The eccentric shaft 124 also revolves about the axis A. With such revolution of the eccentric shaft 124 its pair of offset extensions 126 and 128 reciprocate up and down along the respective guideways 144 and so causes reciprocatory or vibratory motion of the shafts 112, 114 and 124 and worm wheel 110, and consequently of the reciprocator 62, in the horizontal direction.

Thus the pair of offset extensions 126 and 128 act to cancel the vertical component of the worm wheel rotation and to transmit only its horizontal component to the reciprocator 62. Since this reciprocator is mounted on the trunnion 40 against axial displacement, the inking roller 20 vibrates end to end with the reciprocator. The amplitude of this vibration is twice the distance E, FIGS. 4A through 4B, between the worm wheel axis A and the eccentric shaft extension axis C.

Consequently, for changing the amplitude of inking roller vibration, the eccentricity E may be varied by the amplitude adjustment 146. A consideration of FIGS. 4A through 4D will reveal that the eccentricity E is subject to change depending upon which of the four radial taper bores 156-1 through 156-4 the taper head 158 of the lockpin 148 is engaged in. In FIG. 4A the lockpin head 158 is engaged in the first radial taper bore 156-1 in the hollow shaft extension 152, with the result that the eccentric shaft extension axis C is diametrically opposed to the worm wheel axis A. The eccentricity E is at a maximum in this arrangement.

Figure 4C:
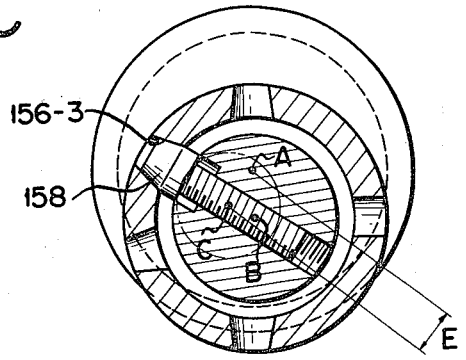
Figure 4D:
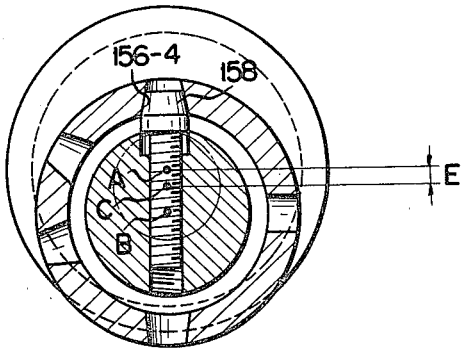

The eccentricity E decreases stepwise as the lockpin 158 is engaged in the second radial taper bore 156-2 as in FIG. 4B, and in the third radial aper bore 156-3 as in FIG. 4C. The eccentricity E comes to a minimum upon engagement of the lockpin head 158 in the fourth radial taper bore 156-4 as in FIG. 4C. Thus the lockpin head 158 may be driven into any selected one of the four radial taper bores 156-1 through 156-4 to cause the endwise vibration of the inking roller 20 with a desired amplitude.

For inserting the taper head 158 of the lockpin 148 into a different radial taper bore, the lockpin may first be loosened and disengaged from the bore in which it has been engaged, by means of a wrench inserted into a hexagonal socket 162 in the lockpin head through a space 164, FIG. 3. Then, with another tool held inserted into the cylindrical bore 160 in the hollow shaft extension 152, the eccentric shaft 124 may be turned about its axis B relative to the hollow shaft 114, etc., by means of the wrench fitted in a hexagonal socket 166 in the eccentric shaft extension 128, until the lockpin 148 comes into alignment with the desired new radial taper bore. Then the lockpin 148 may be turned and extended into engagement in the new radial taper bore by the wrench inserted into its socket 162 through this new taper bore.

It is understood that in the offset perfecting press of FIG. 1, all the other inking rollers 16, 16′ and 20′ are equipped with their own variable-amplitude vibrators identical with the vibrator 38 described in the foregoing. The initial angular position of the worm wheel 110 and other rotary members with respect to the worm 86 determines the phase of the vibratory motion of each inking roller. Tuus, for causing the vibratory motions of the various inking rollers to counteract and cancel each other, their relative phases may be appropriately selected as at the time of the assemblage of the vibrators. Such mutual cancellation of the inking roller vibrations will result in substantial improvement in the durability of the printing press.

A variety of modifications, variations and adaptations of this invention will occur to those skilled in the art without departure from the spirit or scope of the invention as expressed in the following claims.

What is claimed is:

1. In a rotary-type printing press, in combination:

(a) at least one inking roller having a trunnion;

(b) support means supporting the trunnion so as to permit both rotary motion and endwise vibration of the inking roller;

(c) a reciprocator rotatably mounted on the trunnion and restrained from displacement in the axial direction of the trunnion for simultaneous vibratory motion therewith;

(d) a worm fixedly mounted on the trunnion;

(e) a worm wheel meshing with the worm and rotatably supported by the reciprocator, the worm wheel being adapted for simultaneous vibratory motion with the reciprocator;

(f) an eccentric shaft supported eccentrically by the worm wheel for simultaneous rotation therewith about the axis of the latter, the eccentric shaft being capable of angular displacement about its own axis relative to the worm wheel;

(g) the eccentric shaft having an offset extension projecting eccentrically from at least one of its opposite ends;

(h) an amplitude adjustment mechanism for adjustably varying the distance between the axis of the worm wheel and the axis of the offset extension of the eccentric shaft, the amplitude adjustment mechanism permitting the eccentric shaft to be angularly displaced about its own axis relative to the worm wheel and rigidly coupled thereto in a desired angular position; and (i) guide means, mounted in fixed relationship to the support means, providing a guideway extending perpendicular to the axis of the trunnion, the offset extension of the eccentric shaft being engaged in the guideway for rectilinear reciprocation therealong;

(j) whereby upon rotation of the trunnion the eccentric shaft with its offset extension functions to translate the rotation of the worm wheel into the endwise vibratory motion of the inking roller via the reciprocator, the amplitude of the vibratory motion being adjustably varied by the amplitude adjustment mechanism.

2. The invention of claim 1, wherein the amplitude adjustment mechanism comprises:

(a) a hollow shaft formed substantially integral with the worm wheel for simultaneous rotation therewith relative to the reciprocator;

(b) there being a plurality of radial bores formed in the hollow shaft at circumferential spacings;

(c) there being a diametral bore formed in the eccentric shaft; and (d) a lockpin fitted in the diametral bore in the eccentric shaft and having one end projecting outwardly therefrom for engagement in a selected one of the radial bores in the hollow shaft.

3. The invention of claim 2, wherein the worm wheel is rotatably supported by the reciprocator via the hollow shaft.

4. The invention of claim 3, wherein the hollow shaft includes an offset extension concentrically surrounding part of the eccentric shaft, the radial bores being formed in the offset extension of the hollow shaft.

5. The invention of claim 4, wherein the offset extension of the hollow shaft has an annular recess formed internally therein to encircle the part of the eccentric shaft with clearance.

6. In a printing press wherein at least one inking roller is supported by support means for both rotary motion and end-to-end vibratory motion, the inking roller having a trunnion coaxially extending from one of its opposite ends, a variable-amplitude vibrator comprising:

(a) a reciprocator to be rotatably mounted on the trunnion of the inking cylinder and to be restrained from displacement in its axial direction for simultaneous vibratory motion therewith;

(b) a worm to be fixedly mounted on the trunnion for simultaneous rotation therewith;

(c) a worm wheel in mesh with the worm;

(d) a hollow shaft formed substantially integral with the worm wheel in coaxial relationship thereto and rotatably mounted to the reciprocator;

(e) there being a plurality of radial bores formed in the hollow shaft at circumferential spacings;

(f) an eccentric shaft extending eccentrically through the worm wheel and the hollow shaft for angular displacement about its own axis relative to the worm wheel and the hollow shaft;

(g) there being a diametral bore formed in the eccentric shaft;

(h) a lockpin fitted in the diametral bore in the eccentric shaft and having one end projecting outwardly therefrom for engagement in a selected one of the radial bores in the hollow shaft;

(i) the eccentric shaft having an offset extension projecting eccentrically from one end thereof; and (j) guide means, to be mounted in fixed relationship to the support means of the printing press, for defining a guideway extending perpendicular to the axis of the trunnion, the offset extension of the eccentric shaft being engaged in the guideway for rectilinear reciprocation therealong;

(k) whereby upon rotation of the trunnion the eccentric shaft with its offset extension functions to translate the rotation of the worm wheel into the vibratory motion of the inking roller via the reciprocator, the amplitude of the vibratory motion being subject to change depending upon which of the radial bores in the hollow shaft the lockpin is engaged in.

7. The invention of claims 1, 2 or 6, wherein the distance between the axis of the worm wheel and the axis of the eccentric shaft is greater than the distance between the axis of the eccentric shaft and the axis of its offset extension.

* * * * *